US008923725B2

(12) United States Patent
Uneme et al.

(10) Patent No.: US 8,923,725 B2
(45) Date of Patent: Dec. 30, 2014

(54) CLEANING DEVICE, DEVELOPING DEVICE, PROCESS CARTRIDGE AND IMAGE FORMING APPARATUS WITH ELASTICALLY CONTACTING SHEET

(71) Applicant: Canon Kabushiki Kaisha, Tokyo (JP)

(72) Inventors: Tetsushi Uneme, Kawasaki (JP); Tatsuya Takiguchi, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 13/727,819

(22) Filed: Dec. 27, 2012

(65) Prior Publication Data

US 2013/0223874 A1 Aug. 29, 2013

(30) Foreign Application Priority Data

Feb. 28, 2012 (JP) ..... 2012-041364
Dec. 5, 2012 (JP) ..... 2012-266166

(51) Int. Cl.
*G03G 15/08* (2006.01)
*G03G 21/18* (2006.01)
*G03G 21/00* (2006.01)

(52) U.S. Cl.
CPC ..... *G03G 21/0005* (2013.01); *G03G 21/1832* (2013.01); *G03G 15/0898* (2013.01)
USPC ..... 399/102; 399/105

(58) Field of Classification Search
USPC ..... 399/102–106
See application file for complete search history.

(56) References Cited

U.S. PATENT DOCUMENTS

2006/0269317 A1* 11/2006 Fukuta ..... 399/103
2011/0311265 A1* 12/2011 Ueno ..... 399/102

* cited by examiner

*Primary Examiner* — G. M. Hyder
(74) *Attorney, Agent, or Firm* — Fitzpatrick, Cella, Harper & Scinto

(57) ABSTRACT

A cleaning device wherein a cleaner container is provided with an opening, opposing an image bearing drum, for permitting a developer removed from the drum by a cleaning member to enter the container. The cleaning member is fixed at a downstream side of the opening with respect to a rotational moving direction of the drum. The container is provided with a fixing surface for a flexible sheet at an upstream side of the opening with respect to the direction. The sheet is fixed to the fixing surface at an end portion thereof opposite an end portion thereof where the sheet contacts the drum, and at an end portion of the fixing surface with respect to a drum axis direction, the fixing surface protrudes toward a upstream side with respect to a rotational moving direction of the drum beyond a central portion of the fixing surface.

17 Claims, 8 Drawing Sheets

(a)

(b)

CLEANING DEVICE, DEVELOPING DEVICE, PROCESS CARTRIDGE AND IMAGE FORMING APPARATUS WITH ELASTICALLY CONTACTING SHEET

FIELD OF THE INVENTION AND RELATED ART

The present invention relates to a cleaning device, a developing device, a process cartridge and an image forming apparatus.

The image forming apparatus forms an image on a recording material using an image forming process of the electrophotographic type, an electrostatic recording type, a magnetic recording system or the like. Examples of such an image forming apparatus include a copying machine, a printer (laser beam printer or LED printer for example), a facsimile machine, a complex function machine thereof, a word processor and so on.

The recording material is paper or OHT sheet or the like on which the image is formed by the image forming apparatus.

The cleaning device includes cleaning means for removing the developer remaining on a rotatable image bearing member on which an image of the developer to be transferred onto the recording material. The cleaning device is included in the process cartridge, or included in an image forming apparatus, or is detachably mounted as a cleaning cartridge.

The image bearing member is an electrophotographic photosensitive member in the electrophotographic type, a dielectric member for electrostatic recording in the electrostatic recording type, and a magnetic member for magnetic recording in the magnetic recording system.

The developing device includes developing means for developing a latent image formed on the rotatable image bearing member with the developer. The developing device is included in the process cartridge, or is included in the image forming apparatus, or is detachably mounted as a developing cartridge.

The process cartridge is a unit in which an image bearing member for bearing a latent image, and at least one of image forming process means actable on the image bearing member such as charging means, developing means and cleaning means are unified. It is detachably mountable to a main assembly of the image forming apparatus. The main assembly of the apparatus is a structural portion of the image forming apparatus except for the process cartridge. The process cartridge can be mounted and demounted relative to the main assembly of the apparatus by a user. Therefore, the maintenance of the image forming apparatus is easy.

Therefore, the process cartridge includes a unit which is demountable from the main assembly of the apparatus and in which the image bearing member and the developing means as the image forming process means are unified. The process cartridge including the image bearing member and the developing means is called an "integral type" cartridge. A process cartridge including the image bearing member and process means other than the developing means is called a "separable type" cartridge. In the separable type, the developing means is provided in another unit, that is, a developing unit, and the image is formed by a combination of the process cartridge and such a developing unit.

In the present invention, the process cartridge includes a rotatable image bearing member on which a developer image to be transferred onto the recording material is formed, and the cleaning device for removing the developer remaining on the surface of the image bearing member. Or, in the present invention, the process cartridge includes a rotatable image bearing member on which a developer image to be transferred onto the recording material is formed, and the developing device for developing the latent image formed on the image bearing member with a developer. Or, it includes at least a rotatable image bearing member on which a developer image to be transferred onto the recording material is formed, and both of the cleaning device and the developing device.

The description will be made as to an example of the image forming apparatus which is an electrophotographic image forming apparatus such as a printer using an electrophotographic process. The image forming apparatus electrically charges uniformly the rotatable electrophotographic photosensitive member (photosensitive drum) as the image bearing member and forms the latent image by selective exposure of the photosensitive drum. The latent image is visualized with the developer (toner) into a toner image. The toner image is transferred onto the recording material. Or, it is transferred onto the recording material through an intermediary transfer member.

The toner image transferred onto the recording material is heated and/or pressed so as to be fixed on the recording material into a fixed image. Then, the photosensitive drum is cleaned by removing remaining toner from the surface thereof by the cleaning means to be prepared for the next image forming operation.

Conventionally, such an image forming apparatus requires toner supply and maintenance operations for various process means. In order to make a toner supplying operation and/or the maintenance operations, all or a part of the photosensitive drum, the charging means, the developing means, the cleaning means and so on are unified into a cartridge. The process cartridge is detachably mountable to the main assembly of the apparatus (cartridge type).

With the process cartridge type, the maintenance operations can be carried out in effect by exchange of the process cartridge, the developing device, or the cleaning device, and therefore, the operationality can be improved remarkably. For this reason, the process cartridge type is widely used in the image forming apparatus.

The cleaning device includes a cleaning member contacts the surface of the photosensitive drum to scrape the toner off the photosensitive drum. It also includes an elastic flexible sheet (a residual toner collection sheet) contacted to the surface of the photosensitive drum. The cleaning member and the residual toner collection sheet are supported by a fixing portion provided on a cleaner container.

The residual toner collection sheet contacts the surface of the photosensitive drum to prevent leakage of the residual toner through between the residual toner collection sheet and the photosensitive drum. If the residual toner collection sheet is waved, the residual toner collection sheet and the photosensitive drum are partly contacted and are partly spaced with the result of leakage of the residual toner through the spaced portion.

The residual toner scraped off the cleaning member is collected as residual toner through an opening formed between the cleaning member and the residual toner collection sheet and is guided toward a residual toner accommodation chamber.

The developing device further includes a layer thickness regulating member contacting the surface of the developer carrying member (developing roller) which is the developing means, for stabilized carrying of the toner on the developing roller. An elastic flexible sheet (toner sealing sheet) is contacted to the surface of the developing roller. The layer thickness regulating member and the toner sealing sheet are supported by a fixing portion provided on a developing container.

The toner sealing sheet prevents leakage of the toner through between the toner sealing sheet and the developing roller by contacting to the surface of the developing roller. Therefore, if the toner sealing sheet is waved, the toner sealing sheet partly contacts the developing roller and partly does not, where the toner leaks.

Therefore, the toner sealing sheet is made convex toward the developing roller adjacent to the longitudinally center portion of the developing roller to prevent the waving of the toner sealing sheet. The toner is supplied to the developing roller through the opening formed between the layer thickness regulating member and the toner sealing sheet.

Here, the toner sealing sheet is fixed in a developing device or the like having a toner sealing sheet (sealing means) contacting the developing roller over the longitudinal direction (rotational axial direction) of the developing roller, as follows. In the direction perpendicular to the longitudinal direction of the developing roller, one end portion side is contacted to the developing roller, and the other end portion side is fixed to a toner sealing sheet fixing surface of a container frame of the developing device or the like.

In the case that the toner sealing sheet extends in parallel with the longitudinal direction relative to the toner sealing sheet fixing surface, there is a liability under a high temperature condition that the toner sealing sheet fixing surface deforms with the result of waving of the toner sealing sheet.

Therefore, the toner sealing sheet is fixed in a state that it is convex toward the developing roller adjacent to the longitudinally center portion. The other end portion side where the toner sealing sheet contacts the developing roller is fixed so as not to protrude beyond the toner sealing sheet fixing surface.

However, with the downsizing of the container frame of the developing device or the like, the toner sealing sheet fixing surface has to be necessarily downsized. Therefore, both end portions of the toner sealing sheet at the other end portion side may protrude beyond the toner sealing sheet fixing surface. When the toner sealing sheet protrudes beyond the toner sealing sheet fixing surface, the toner sealing sheet may be removed by unintentional contact of the user's hand or finger to the protruded portion of the toner sealing sheet during the user's handling.

The same applies to between the residual toner collection sheet and the residual toner collection sheet fixing surface.

SUMMARY OF THE INVENTION

Accordingly, it is a principal object of the present invention to provide a cleaning device, a developing device, a process cartridge and an image forming apparatus, in which a toner sealing sheet (or residual toner collection sheet) is fixed to a container frame of a developing device or the like, and the toner sealing sheet (residual toner collection sheet) does not protrude even when the toner sealing sheet fixing surface (or residual toner collection sheet fixing surface) is narrow. By doing so, the downsizing of the cleaning device, the developing device, the process cartridge and the image forming apparatus are accomplished.

According to an aspect of the present invention, there is provided a cleaning device mountable to an image forming apparatus including a rotatable image bearing member for bearing an image of a developer to be transferred onto a recording material, said cleaning device comprising a cleaning member for removing the developer remaining on the image bearing member, a cleaner container accommodating a developer removed by said cleaning member; and a flexible sheet elastically contacting the image bearing member, wherein said cleaner container is provided with an opening, opposing said image bearing member, for permitting the developer removed from said image bearing member by said cleaning member to enter said cleaner container, wherein said cleaning member is fixed at a downstream side of the opening with respect to a rotational moving direction of the image bearing member, wherein said cleaner container is provided with a fixing surface for said flexible sheet at an upstream side of the opening with respect to the rotational moving direction, wherein said flexible sheet is fixed to said fixing surface at an end portion thereof opposite an end portion thereof where said flexible sheet contacts the image bearing member, and wherein at an end portion of said fixing surface with respect to a rotational axis direction of the image bearing member, said fixing surface protrudes toward a upstream side with respect to a rotational moving direction of the image bearing member beyond a central portion of said fixing surface.

According to another aspect of the present invention, there is provided a developing device mountable to an image forming apparatus including a rotatable image bearing member for bearing an image of a developer to be transferred onto a recording material, said developing device comprising a rotatable developer carrying member for carrying the developer and applying it to the image bearing member; a layer thickness regulating member for regulating a layer thickness of the developer deposited on said developer carrying member; a developing container for accommodating the developer to be supplied to said developer carrying member; and a flexible sheet elastically contacting said developer carrying member; wherein said developing container is provided with an opening opposing said image bearing member, wherein said developer carrying member is rotatably provided in said opening, wherein said layer thickness regulating member is fixed at a position downstream of said opening with respect to a rotational moving direction of the developer carrying member, wherein a fixing surface for said flexible sheet is provided at an upstream side of the opening with respect to the rotational moving direction, wherein said flexible sheet is fixed to said fixing surface at an end portion thereof opposite an end portion thereof where said flexible sheet contacts said developer carrying member, and wherein at an end portion of said fixing surface with respect to a rotational axis direction of the developer carrying member, said fixing surface protrudes toward an upstream side with respect to a rotational moving direction of the developer carrying member beyond a central portion of said fixing surface.

According to the present invention, the toner sealing sheet (or residual toner collection sheet) is fixed to the container frame of the developing device or the like, and the toner sealing sheet (residual toner collection sheet) does not protrude even when the toner sealing sheet fixing surface (or residual toner collection sheet fixing surface) is narrow. By doing so, the downsizing of the cleaning device, the developing device, the process cartridge and the image forming apparatus are accomplished. The same applies to the relation between the residual toner collection sheet and the residual toner collection sheet fixing surface.

These and other objects, features, and advantages of the present invention will become more apparent upon consideration of the following DESCRIPTION OF THE EMBODIMENTS of the present invention, taken in conjunction with the accompanying drawings.

BRIEF DESCRIPTION OF THE DRAWINGS

Part (a) of FIG. 1 is a schematic sectional view (corresponding to a sectional view taken along V-V of FIG. 2), (b)

is a schematic sectional view (corresponding to a sectional view taken along X-X of FIG. 2) of a fixing surface for a toner sealing sheet.

DESCRIPTION OF THE EMBODIMENTS (Embodiment 1)

Referring to the accompanying drawings, a first embodiment of the present invention will be described. An electrophotographic image forming apparatus of this embodiment is a full-color electrophotographic image forming apparatus to which four process cartridges each including a cleaning device and a developing device are detachably mountable. However, the number of the kinds of the process cartridges mountable to the image forming apparatus is not limited to four. If necessary, it may be properly changed. For example, in the case of an image forming apparatus for forming a monochromatic image, the kind of the process cartridge is one.

In this embodiment, the image forming apparatus is a printer. However, the present invention is not limited to this example. For example, the present invention is applicable to a copying machine, a facsimile machine, or another image forming apparatus such as a complex machine.

(General Arrangement of Image Forming Apparatus)

Figure 2:
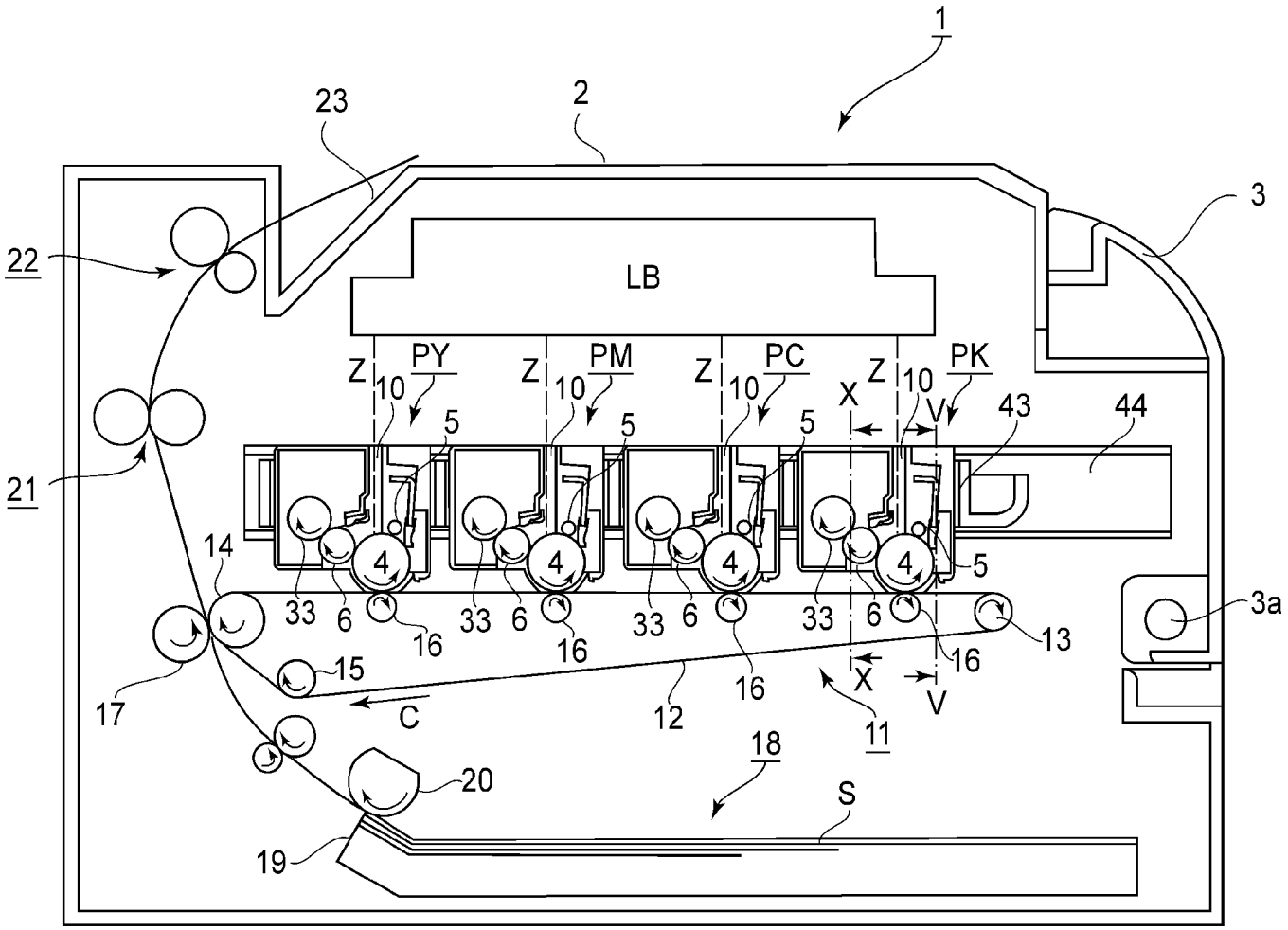
FIG. 2 is a schematic sectional view of an example of an image forming apparatus.

FIG. 2 is a schematic section of the image forming apparatus of this embodiment. The image forming apparatus 1 is a four full-color laser beam printer using an electrophotographic process and carries out a color image formation on a recording material S. It forms an image on the recording material S in the form of a sheet on the basis of image information (electrical image signal) inputted to a control circuit portion (unshown) from an external host apparatus (unshown). The external host apparatus is a personal computer, an image reading apparatus, a facsimile machine, a network or the like.

The image forming apparatus 1 is a process cartridge type apparatus to which a process cartridge (cartridge) P is dismountably mounted, and a color image is formed on the recording material S.

Here, the side of the image forming apparatus 1 provided with an opening and closing door 3 is a front side, and the side opposite the front side is a rear side. The left and right of the image forming apparatus 1 are left-hand and right-hand sides as seen from the front side. The upside and downside are based on the direction of gravity. In the image forming apparatus 1 of this embodiment, the right-hand side is a driving side, and the left-hand side is a non-driving side.

In the main assembly of the apparatus 2, a first cartridge PY, a second cartridge PM, a third cartridge PC and a fourth cartridge PK are arranged in the horizontal direction.

The first-fourth cartridges P (PY, PM, PC, PK) have similar electrophotographic processing mechanisms, although the colors of the developers (toners) therein are different. In the state that the first-fourth cartridges P (PY, PM, PC, PK) are mounted in a predetermined manner in the main assembly 2 of the apparatus 2 (FIG. 2), each cartridge can receive a rotational force from a drive outputting portion (unshown) of the main assembly 2 of the apparatus. Each cartridge can receive a bias voltage (charging bias voltage, developing bias voltage or the like) from a bias output portion (unshown) of the main assembly 2.

Figure 3:
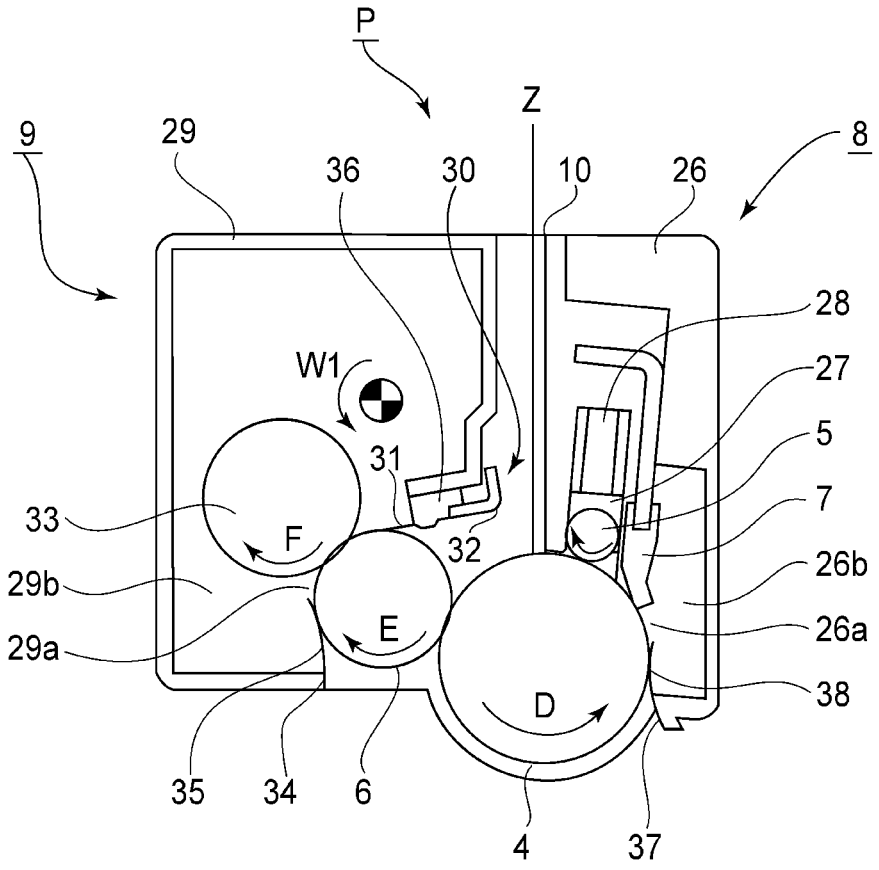
FIG. 3 is a schematic sectional view of a process cartridge.
Figure 4:
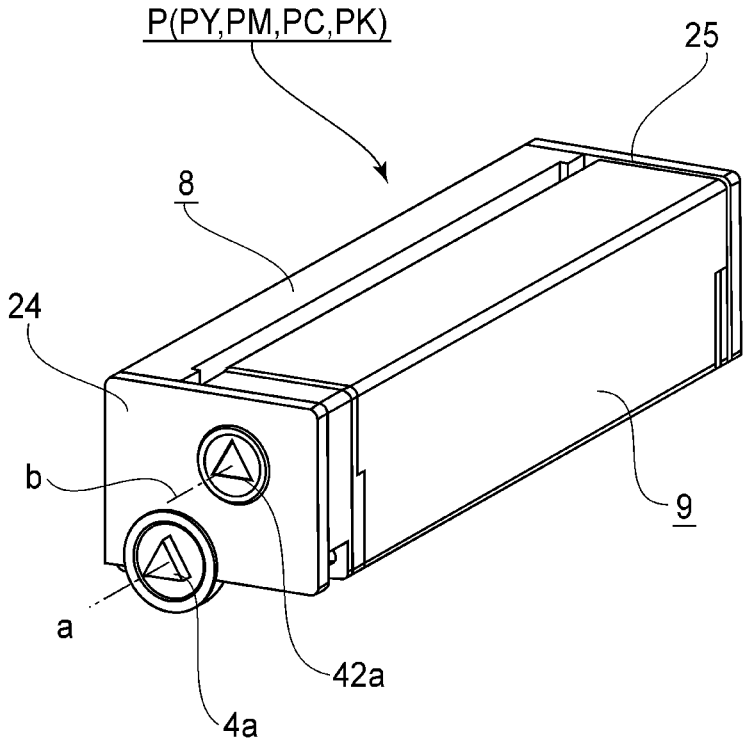
FIG. 4 is a perspective view of an outer appearance of the process cartridge.

FIG. 3 is a schematic enlarged cross-sectional view of the cartridge P of this embodiment, and FIG. 4 is a schematic perspective appearance as seen from a driving side (right side) of the cartridge P. Detail structures of the cartridge P will be described hereinafter, and it generally comprises a cleaning device (cleaning unit) 8 and a developing device (developing unit) 9, which are connected with each other by a shaft W1.

The cleaning device 8 includes a drum type electrophotographic photosensitive member (photosensitive drum) 4 as a rotatable image bearing member, on which a developer image to transferred onto the recording material S is formed. The cleaning unit 8 also includes charging means 5 and cleaning means 7 as image forming process means actable on the photosensitive drum 4. The charging means 5 includes a contact type charging roller. The cleaning means 7 includes a cleaning blade. The photosensitive drum 4, the charging roller 5 and the cleaning blade 7 are mounted to a cleaner container (cleaning frame) 26 of the cleaning device 8.

The developing device 9 includes a rotatable developer carrying member (developing roller) as developing means for carrying the developer (toner) to apply it to the photosensitive drum 4. In this embodiment, the developing device 9 is a contact-type developing device using one component non-magnetic toner as the developer.

The first cartridge PY accommodates yellow (Y) toner in a developer container 29 of the developing device 9 to form the yellow color toner image on a surface of the photosensitive drum 4. The second cartridge PM accommodates magenta (M) toner in a developer container 29 of the developing device 9 to form a magenta color toner image on a surface of the photosensitive drum 4.

The third cartridge PC accommodates cyan (C) toner in a developer container 29 of the developing device 9 to form a cyan color toner image on a surface of the photosensitive drum 4. The fourth cartridge PK accommodates black (K) toner in a developer container 29 of the developing device 99 to form a black color toner image on a surface of the photosensitive drum 4.

Above the first-fourth cartridges P (PY, PM, PC, PK), a laser scanner unit LB as the exposure means is provided. The laser scanner unit LB outputs a laser beam Z corresponding to the image information. The laser beam Z travels through an exposure window 10 of the cartridge P, and the surface of the photosensitive drum 4 is scanningly exposed to the laser beam Z.

Below the first-fourth cartridges P (PY, PM, PC, PK), there is provided an intermediary transfer belt unit 11 as the transfer member. The intermediary transfer belt unit 11 comprises a flexible transfer belt 12 which is stretched around a driving roller 13, a turning roller 14 and a tension roller 15.

Lower surfaces of the photosensitive drums 4 of the first-fourth cartridges P (PY, PM, PC, PK) are contacted to an upper surface of the transfer belt 12. The contact portions therebetween are primary transfer portions. Inside of the transfer belt 12, there are provided primary transfer rollers 16 opposed to the photosensitive drums 4. A secondary transfer roller 17 is urged toward the turning roller 14 through the transfer belt 12. The contact portion between the transfer belt 12 and the secondary transfer roller 17 is a secondary transfer portion.

A feeding unit 18 is provided below the intermediary transfer belt unit 11. The feeding unit 18 includes a sheet feeding tray 19 accommodating a stack of recording material S and a sheet feeding roller 20. As shown in FIG. 2, in an upper left part of the inside of the main assembly 2, there are provided a fixing unit 21 and a discharging unit 22. An upper surface of the main assembly 2 functions as a discharging tray 23. The recording material S is subjected to a fixing operation of the fixing means provided in the fixing unit 21 so that the toner image is fixed, and then is discharged to the discharging tray 23.

(Image Forming Operation)

The operation for forming a full-color image is as follows. The photosensitive drums 4 of the first-fourth cartridges P (PY, PM, PC, PK) are rotated at a predetermined speed in the direction of an arrow D in FIG. 3 (counterclockwise direction in FIG. 2). The transfer belt 12 is also rotated codirectionally with the peripheral movement of the rotation of the photosensitive drum (in the direction of arrow C in FIG. 2) at a speed corresponding to the speed of the photosensitive drum 4. The laser scanner unit LB is also actuated.

In synchronism with drive of the laser scanner unit LB, in the cartridge, the charging roller 5 uniformly charges the surface of the photosensitive drum 4 to a predetermined polarity and potential. The laser scanner unit LB scans the surface of the photosensitive drum 4 with the laser beam in accordance with the image signal for each color. By this, an electrostatic latent image corresponding to the image signal is formed on the surface of each photosensitive drum 4. The electrostatic latent image formed is developed by a developing roller 6 which is rotated at a predetermined speed in the direction of an arrow E in FIG. 3.

Through such an electrophotographic image forming process operation, a yellow color toner image corresponding to a yellow component of the full-color image is formed on the photosensitive drum 4 of the first cartridge PY. The toner image is primary transferred onto the transfer belt 12.

Similarly, a magenta toner image corresponding to a magenta component of the full-color image is formed on the photosensitive drum 4 of the second cartridge PM. The toner image is primary transferred superimposingly on the yellow color toner image already on the transfer belt 12.

Similarly again, a cyan toner image corresponding to a cyan component of the full-color image is formed on the photosensitive drum 4 of the third cartridge PC. The toner image is primary transferred superposingly on the yellow color and magenta color toner images already on the transfer belt 12.

Further similarly, a black toner image corresponding to a black component of the full-color image is formed on the photosensitive drum 4 of the fourth cartridge PK. The toner image is primary transferred superposingly on the yellow color, magenta color, and cyan color toner images already on the transfer belt 12.

In this manner, a four full-color image (unfixed) of yellow color, magenta color, cyan color and black color is formed on the transfer belt 12. On the other hand, a recording material S is singled out of the feeding unit 18 at predetermined control timing. The recording material S is introduced to the secondary transfer portion where the secondary transfer roller 17 and the transfer belt 12 are contacted to each other at predetermined control timing.

By this, the superimposed four color toner image is transferred sequentially all together from the transfer belt 12 onto the surface of the recording material S in the process of the feeding of the recording material S in the secondary transfer portion. The recording material S departing the secondary transfer portion is separated from the transfer belt 12 and is introduced to the fixing unit 21 where the toner image is fixed by the fixing means, and is discharged to the discharging tray 23 as a print.

(Structure of Cleaning Device 8)

As shown in FIG. 4, the cartridge P (PY, PM, PC, PK) is elongated in the direction of a rotational axis a of the photosensitive drum 4 and includes the cleaning device 8, the developing device 9, a driving side covering member 24 and a non-driving side covering member 25.

As shown in FIG. 3, the cleaning unit 8 comprises a photosensitive drum 4, a charging roller 5, and a cleaner container 26 including a cleaning blade 7.

The photosensitive drum 4 is supported rotatably by the driving side covering member 24 and the non-driving side covering member 25. The photosensitive drum 4 receives a driving force from the motor (unshown) of the main assembly 2 through a drum driving coupling **4*a* fixed to one end portion of the photosensitive drum 4** with respect to the rotational axis direction thereby to rotate in the direction of the arrow D.

The charging roller 5 is rotatably supported at the opposite end portions by charging roller bearings 27 of the cleaner container 26, and contacts the surface of the photosensitive drum 4 to rotate relative to the photosensitive drum, and is supplied with the charging bias voltage to charge the surface of the photosensitive drum 4. At this time, in order to charge the surface of the photosensitive drum uniformly, the charging roller 5 is pressed against the photosensitive drum 4 by urging springs 28.

The cleaning blade 7 is fixed to the cleaner container 26, and a free end portion of the elastic rubber portion is contacted to the photosensitive drum 4 counterdirectionally relative to a rotational moving direction (arrow D direction in FIG. 3). In the image forming operation, the untransferred toner remaining on the photosensitive drum 4 is scraped off by the cleaning blade 7 (cleaning member) to clean the surface of the photosensitive drum 4. In order to scrape the untransferred toner sufficiently, the free end of the cleaning blade 7 is contacted to the surface of the photosensitive drum 4 at a predetermined pressure.

The untransferred toner scraped off the surface of the photosensitive drum 4 by the cleaning blade 7 is collected into a residual toner accommodation chamber (residual developer accommodating chamber) **26*b* of the cleaner container 26 as residual toner through an opening portion 26*a* and is stored there. To the cleaner container 26, a flexible residual toner collection sheet (flexible sheet) 38 is fixed and is extended in the longitudinal direction of the photosensitive drum 4 to prevent leakage of the residual toner through a gap between the photosensitive drum 4 and the cleaning blade 7**. In addition, at the opposite longitudinal end portions of the cleaning blade, cleaning blade end portion sealing members (unshown) are provided.

(Structure of Developing Device 9)

As shown in FIGS. 3, 4, the developing device 9 is elongated in the rotation axial direction of the developing roller 6 as the developing means. The developing device 9 includes, in addition to the developing roller 6, a developing container 29 for accommodating the toner, and a developing blade 31 as a layer thickness regulating member for regulating a layer thickness of the toner deposited on the developing roller 6. It further includes a rotatable toner supplying roller (developer feeding member) 33 for supplying the toner to the developing roller 6, and a toner sealing sheet 35 as a flexible sheet contacting to the developing roller 6 with an elasticity.

The developing roller 6 and the toner supplying roller 33 are disposed in the opening 29*a* of the developing container 29, and the opposite end portions of the shafts of the rollers are rotatably supported by driving side bearings (unshown) and non-driving side bearings (unshown) mounted to left and right surfaces of the developing container 29.

The developing device 9 is supported swingably by a shaft W1 between the driving side covering member 24 and the non-driving side covering member 25. That is, the cleaning device 8 and the developing device 9 are connected with each other by the shaft W1. The developing device 9 is rotationally urged about the shaft W1 by an urging member (unshown) so that the developing roller 6 is contacted to the photosensitive drum 4 in the cleaning device 8 at a predetermined urging force, in a free state.

The developing device 9 is rotationally urged about the shaft W1 by an urging member (unshown) so that the developing roller 6 is contacted to the photosensitive drum 4 in the cleaning device 8 at a predetermined urging force, in a free state. The developing drive input gear is provided with a developing drive coupling 42*a*. The developing drive coupling 42*a* is co-axially with an axis b of the shaft W1. By engagement between the developing drive coupling 42*a* and a drive output coupling (unshown) of the main assembly of the device 2, the driving force of the driving motor (unshown) of the main assembly of the device 2 is transmitted to rotate the developing roller 6 and a toner supplying roller 35 at the predetermined speeds in the directions of arrows E and F.

The developing blade 31 is an elastic thin metal plate having a thickness of approx. 0.1 mm and is elongated in the axial direction of the developing roller 6. The developing blade 31 is supported by supporting metal plate 32, which is mounted on the developing container 29. The developing blade unit is constituted by the developing blade 31 and the supporting metal plate 32. A free end, extending in the longitudinal direction, of the developing blade 31 is contacted counterdirectionally relative to the peripheral moving direction of the developing roller 6 (arrow E direction in FIG. 3). Designated by 36 is a lower seal for the developing blade.

During the image forming operation, the toner supplying roller 31 and the developing roller 6 are rotated while rubbing by which the toner in the developing container 29 is applied onto the developing roller 6. The developing blade 31 regulates the thickness of the toner layer formed on the peripheral surface of the developing roller 6, and toner particles are triboelectrically charged by the friction with the pressure therebetween. The charged toner on the developing roller 6 are deposited onto the electrostatic latent image on the photosensitive drum 4 in the contact portion between the developing roller 6 and the photosensitive drum 4 so that the latent image is developed.

Here, the toner other than the toner stably carried by the developing blade 31 on the surface of the developing roller 6 is accommodated in a developer accommodating chamber 29*b*. Therefore, at the opening 29*a* of the developing container 29, the toner sealing sheet 35 for preventing toner leakage through a gap below the developing roller 6 and the developing container 29 is fixed. A developing blade end portion sealing member (unshown) is provided at the opposite longitudinal end portions of the developing blade 31.

(Mounting and Demounting Structure of Cartridge P)

The mounting and demounting operation of the cartridge P (PY, PM, PC, PK) relative to the main assembly 2 will be described. When the cartridge is to be exchanged in the image forming apparatus of this embodiment, the cartridge is on a cartridge tray 43 of a drawer type in a front access manner. The tray 43 supports the cartridge demountably. The cartridge tray 43 is movable along a rail member 44 between a drawn-out position (outside position) in which the cartridges P can be mounted and demounted in an outside of the main assembly 2, and a mounted position in which the cartridges P are set in the main assembly 2.

Figure 5:
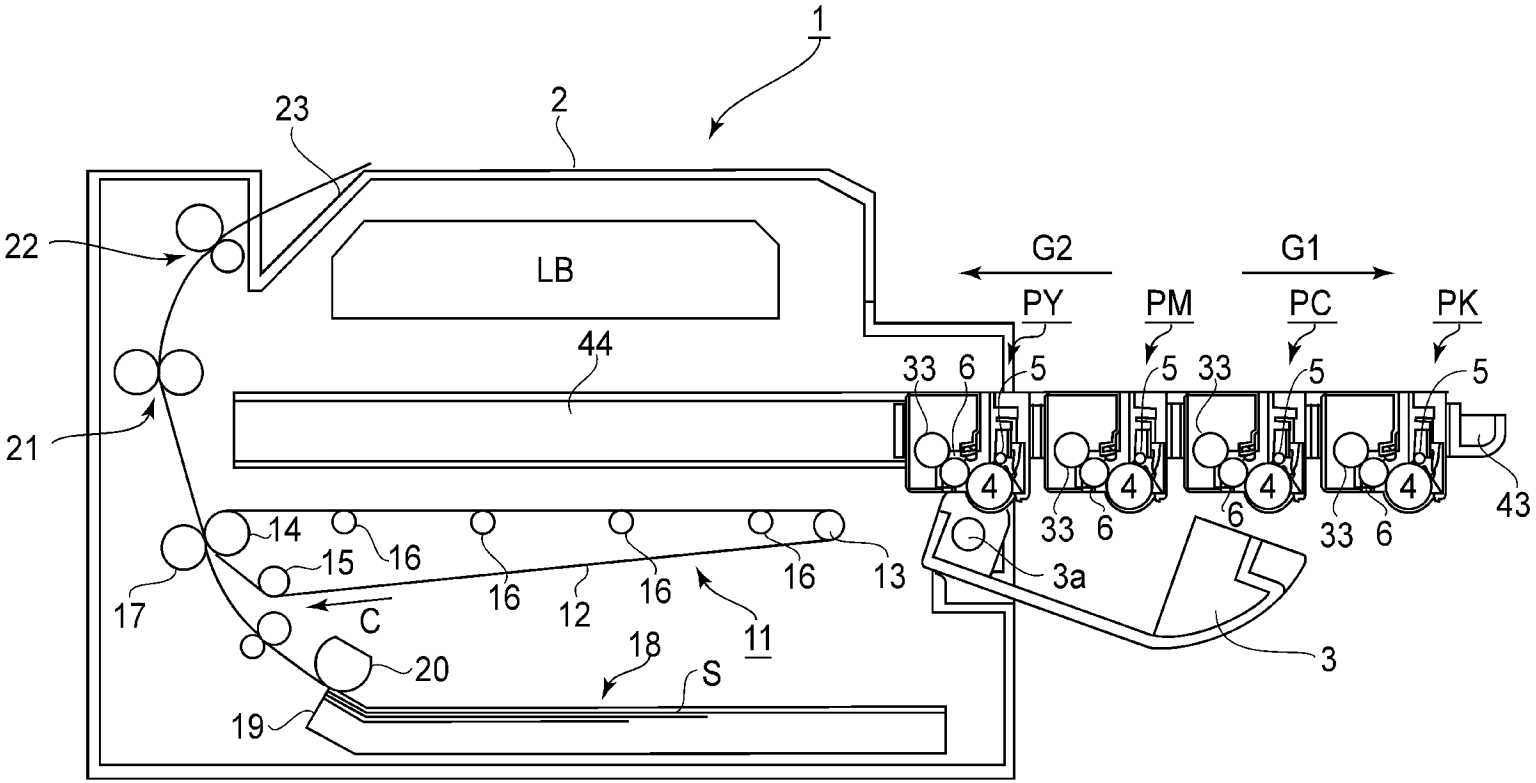
FIG. 5 is a schematic section 1 illustrating a mounting and demounting structure of the process cartridge relative to the main assembly of the image forming apparatus.
Figure 6:
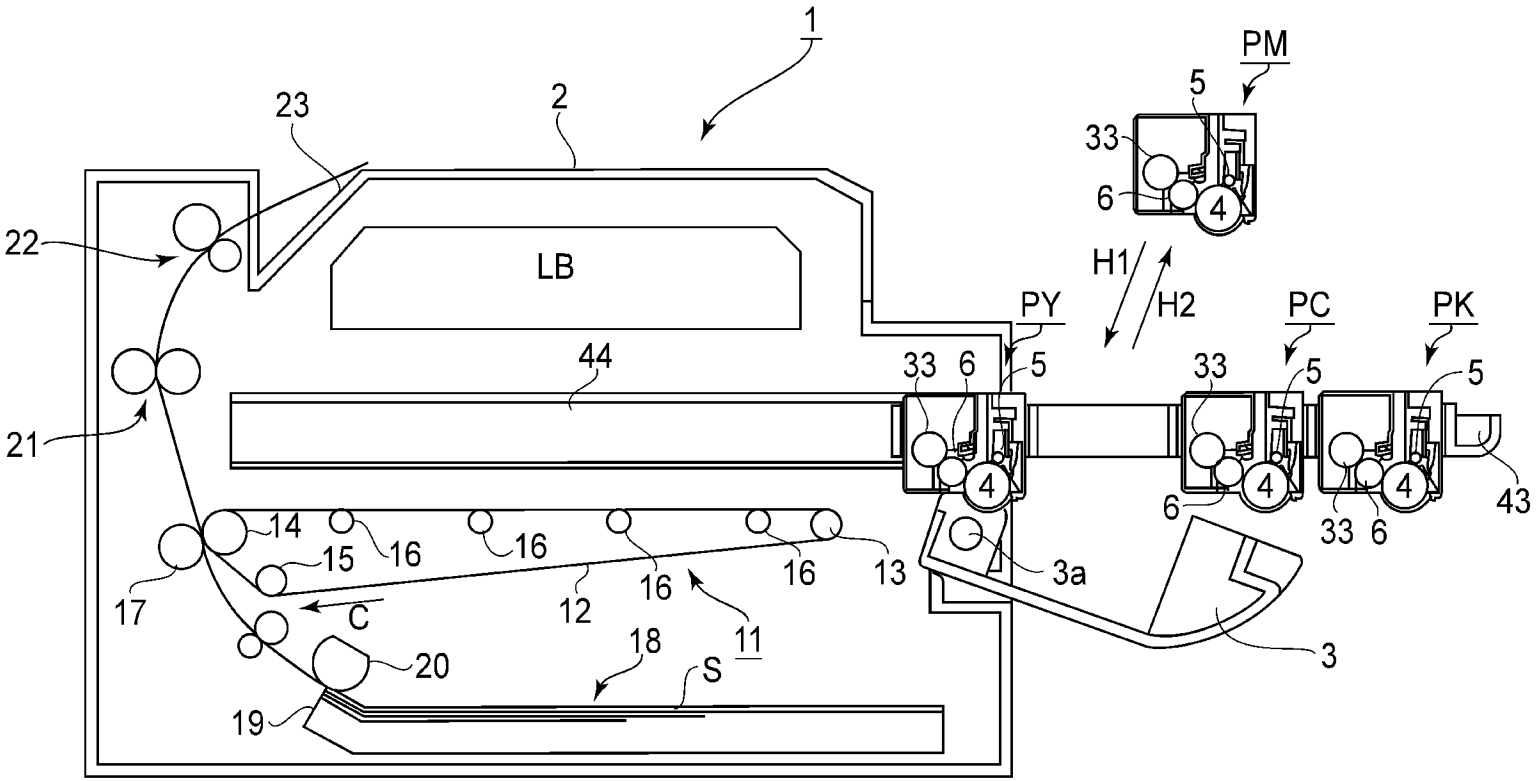
FIG. 6 is a schematic section 2 illustrating a mounting and demounting structure of the process cartridge relative to the main assembly of the image forming apparatus.

FIG. 5 is a schematic sectional view in which the cartridge tray 43 is drawn out of the main assembly 2, and the cartridges P are detachably mountable. FIG. 6 is a schematic sectional view illustrating the mounting and demounting operation of the cartridge P relative to the cartridge tray 43.

The cartridge tray 43 is provided in the main assembly 2. As shown in FIG. 5, the cartridge tray 43 is linearly movable (pushed in and pulled out) along the rail member 43 in the directions G1, G2 which are substantially horizontal direction. The cartridge tray 43 can take the mounted position which is inside the main assembly 2 and the drawn-out position drawn out of the mounted position.

In order to draw the cartridge tray 43 to the drawn-out position, the device door 3 is opened about a hinge shaft 3*a*, and the cartridge tray 43 is moved along the rail members 44 in the arrow G1 in FIG. 5.

In interrelation with the opening operation of the door 3, the connection between the drum driving couplings 4*a* and developing drive coupling 42*a* of the cartridges P are disconnected from the main assembly side. The cleaning device 8 of each cartridge P is released from the pressing to the positioning portion (unshown) of the main assembly side. By movement of the rail member 44 or the intermediary transfer belt unit 11, the photosensitive drum 4 of each cartridge P is spaced from the transfer belt 12. In this state, the movement of the cartridge tray 43 from the mounted position inside the main assembly 2 to the drawn-out position is enabled.

In the state that the cartridge tray 43 has been moved to the drawn-out position, the cartridges P can be exchanged and can be mounted and demounted relative to the cartridge tray 43. The cartridge P is taken out in the direction of an arrow H2 of FIG. 6 from the cartridge tray 43, and it is mounted in the direction of an arrow H1 on the cartridge tray 43, and it is kept there. After a cartridge P on the tray is taken out and a new cartridge P is mounted in the direction of the arrow H1, the cartridge tray 43 is pushed into the main assembly 2 to a sufficient extent. Then, the door 3 is closed.

In interrelation with the closing operation of the door 3, the contact between the transfer belt 12 and the photosensitive drum 4 of the cartridges P are established by the movement of the rail member 100 or the intermediary transfer belt unit 11. The cleaning device 8 of the cartridge P is pressed against the positioning portion (unshown) of the main assembly. The drum driving coupling 4*a* and the developing drive coupling 42*a* of each cartridge P is brought into connection with the main assembly side. By this, the cartridges P are mounted to the predetermined mounted positions relative to the main assembly 2, by which the image forming operation of the image forming apparatus 1 is enabled.

(Structure of Residual Toner Collection Sheet Fixing Surface)

Figure 1:
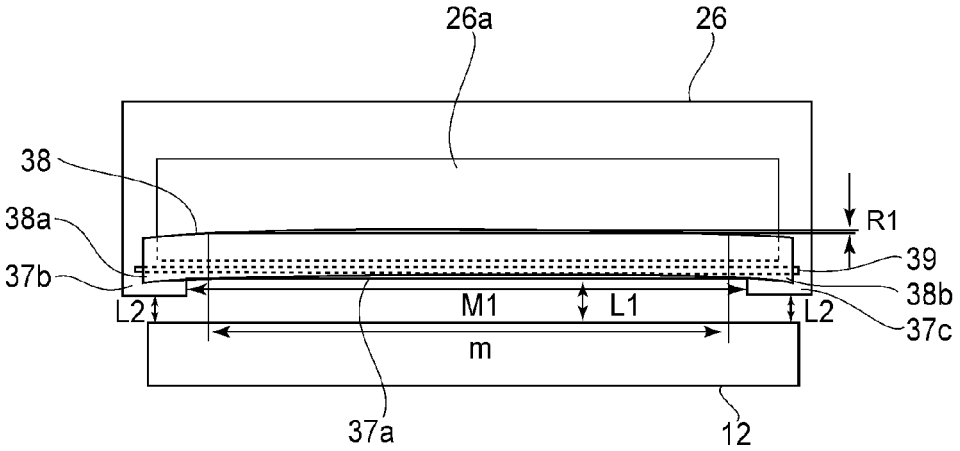
Figure 1:
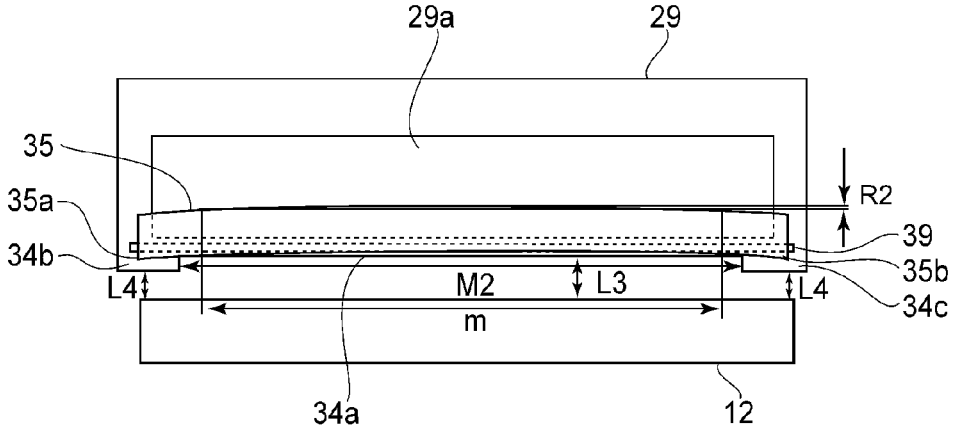

Part (a) of FIG. 1 is a schematic sectional view of the process cartridge and a transfer belt portion shown in FIG. 2 shows a residual toner collection sheet fixing surface 37. The residual toner collection sheet fixing surface 37 will be described hereinafter referring to FIG. 7.

The cleaner container shown in part (a) of FIG. 1 is provided with an opening 26*a* which opposes to the photosensitive drum 4 and through which the untransferred residual developer scraped off the photosensitive drum 4 by the cleaning blade 7 fixed to the cleaner container 26. The cleaning blade 7 is fixed to a downstream side of the opening 26*a* with respect to a rotational moving direction of the photosensitive drum 4.

An upstream side of the opening 26*a* with respect to the rotational moving direction of the photosensitive drum 4, there is provided a fixing surface 37 for the residual toner collection sheet 38, and the other end portion, not contacted to the photosensitive drum 4, of the residual toner collection sheet 38 is fixed to the fixing surface 37. As shown in FIG. 3, the residual toner collection sheet 38 is fixed to the residual toner collection sheet fixing surface 37 so that the surface of the residual toner collection sheet 38 is contacted to the photosensitive drum 4. The residual toner collection sheet 38 is fixed to the residual toner collection sheet fixing surface 37 at the side opposite the side contacted to the photosensitive drum 4, using a double coated tape 39 in this embodiment, but the fixing method is may be another. The residual toner collection sheet 38 is an elongated flexible sheet having two sides extending in the longitudinal direction, and is made of a polyethylene terephthalate sheet having a thickness of 50 μm, but the configuration and the material are not limited to this example.

The residual toner collection sheet 38 is curved and fixed on the residual toner collection sheet fixing surface 37 in the state that a neighborhood of a longitudinally center portion of the residual toner collection sheet 38 is convex toward the photosensitive drum 4 in a direction perpendicular to the longitudinal direction.

A length of an image forming region in which the toner image is transferred onto the transfer belt 12 is m. The longitudinally extending side of the residual toner collection sheet 38 contacting the photosensitive drum 4 is warped by R1=0.1-1.5 mm adjacent the longitudinally center portion in the range of the image forming region m relative to the opposite end portions.

Figure 7:
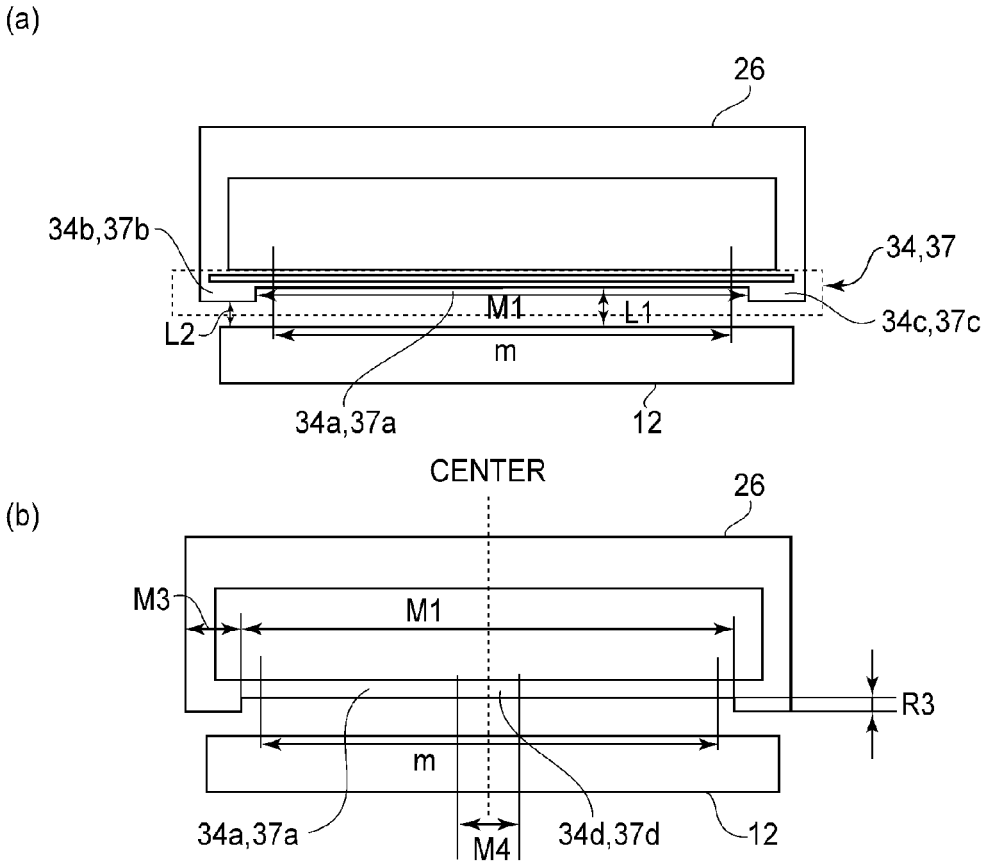
FIG. 7 includes parts (a) and (b) which are schematic sectional views of a fixing surface.

Referring to FIG. 7, the residual toner collection sheet fixing surface 37 will be described. As shown in part (a) of FIG. 7, the residual toner collection sheet fixing surface 37 is a portion of the cleaner container 26 surrounded by broken lines. As shown in part (b) of FIG. 7, the residual toner collection sheet fixing surface 37 includes end portions 37*b* having a length M3 and a supporting portion 37*a* having a length M1. The end portion 37*b* is longer than a central portion 37*d* (including the center portion central portion 37*d* of the fixing surface) and the supporting portion 37*a* in the directing direction perpendicular to the length M3. The difference in the length is R3. The portion of R3 is effective to prevent the protrusion of the residual toner collection sheet attributable to the above-described warping of the residual toner collection sheet. Therefore, it will suffice if R3 is larger than 0, but if it is too large, the apparatus will be upsized. It has been found that it is preferable that R1>R3>0 are satisfied. This is because then the protrusion of the sheet can be prevented while suppressing upsizing of the device and apparatus. More specifically, R3=0.3 mm when R1=0.6 mm in this embodiment.

In part (a) of FIG. 1, a longitudinal range 37 of the residual toner collection sheet fixing surface 37 has a length M1, ranges 37*b* and 37*c* are outside the range 37*a*. The residual toner collection sheet fixing surface portions 37*b*, 37*c* extend in a direction away form the photosensitive drum 4 in the direction perpendicular to the longitudinal direction (opposite direction).

Thus, by extending only the end portions of the sheet fixing surface in the direction opposite the convex direction of the sheet, by which the sheet do not protrude beyond the fixing surface.

In other words, the opposite end portions 37*b* and 37*c* (with respect to the rotational axial direction of the photosensitive drum 4) of the fixing surface 37 is wider than the neighborhood of the center portion (with respect to the rotational axial direction of the photosensitive drum 4), in a direction perpendicular to the rotational axial direction of the photosensitive drum 4, away from the opening 26*a* side.

In addition, the fixing surface 37 is wider outside the image forming region (with respect to the rotational axial direction of the photosensitive drum 4) than in the image forming region, in a direction perpendicular to the rotational axial direction of the photosensitive drum 4, away from the opening 26*a* side.

Figure 8:
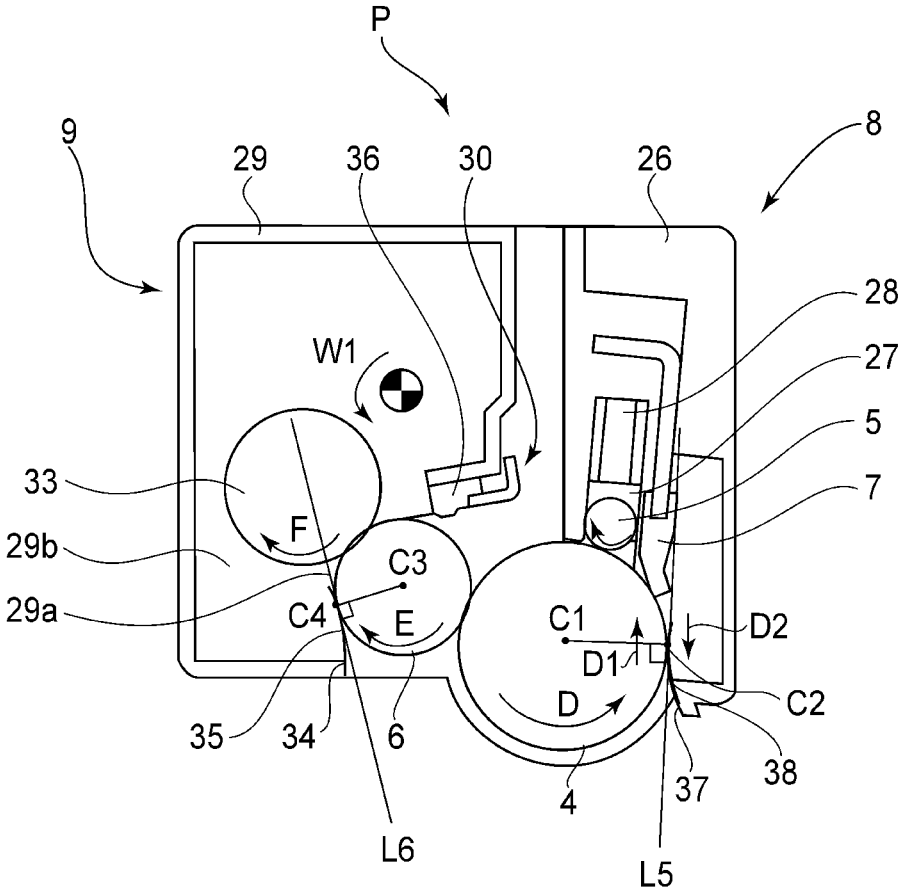
FIG. 8 is a schematic sectional view of a process cartridge illustrating a configuration of the fixing surface.

Referring to FIG. 8, further description will be made. In FIG. 8 (sectional view), the photosensitive drum 4 is circular having a center point at C1 which is the rotational axis point. The residual toner collection sheet 38 contacts the photosensitive drum 4 at a contact point (C2). A tangent plane therebetween includes a tangent line L5 in the shown cross-section, and the end portion of the residual toner collection sheet fixing surface 37 extends toward a upstream side of the contact point with respect to the advancing direction (arrow D1) of the surface of the photosensitive drum. In other words, the end portion of the sheet fixing surface 37 is wider in the direction (arrow D2) opposite the advancing direction of the surface of the photosensitive drum than the central portion 37*d* (including the center portion of the fixing surface) and the supporting portion 37*a* of the fixing surface. This is because the residual toner collection sheet is convex toward the photosensitive drum.

In summary, at an end portion of the fixing surface with respect to a rotational axis direction of the image bearing member, the fixing surface protrudes toward a upstream side with respect to a rotational moving direction of the image bearing member beyond a central portion of the fixing surface, and more particularly, the fixed end surface protrude toward an upstream side with respect to a plane perpendicular to a tangent plane between the photosensitive drum (image bearing member) and the residual toner collection sheet (flexible sheet).

By this, even if the residual toner collection sheet 38 is curved by the curving degree R1, it can be fixed to the residual toner collection sheet fixing surface 37 over the entire longitudinal area by the double coated tape 39, for example. In addition, the end portions 38*a*, 38*b* of the residual toner collection sheet 38 projected away from the photosensitive drum 4 in the direction perpendicular to the longitudinal direction on the residual toner collection sheet fixing surface 37 are within the ranges of the residual toner collection sheet fixing surfaces 37*b*, 37*c*, respectively.

At this time, the region M1 is widened toward a longitudinally outside beyond the image forming region m (outside the image forming region). A distance between the transfer belt 12 and the supporting portion 37*a* of the residual toner collection sheet fixing surface is L1, and a distance between the transfer belt 12 and end portions 37*b*, 37*c* of the residual toner collection sheet fixing surface is L2.

The distance L1 is larger than L2 so that the toner on the transfer belt 12 is not deposited onto the cleaner container 26 by an electrostatic force of the cleaner container 26. The distance L2 can be made close to such a distance that the residual toner collection sheet fixing surface 37*b*, 37*c* do not contact the surface of the transfer belt 12 even taking the dimensional variation due to the tolerance into consideration, and therefore, the cleaner container 26 and the image forming apparatus 1 can be downsized.

(Structure of Toner Sealing Sheet Fixing Surface)

The above-described structures of the residual toner collection sheet fixing surface can be applied to the toner sealing sheet fixing surface.

Part (b) of FIG. 1 shows the structure of the toner sealing sheet fixing surface 34 in the cross-section taken along the line X-X in FIG. 2.

The developing container 29 has an opening 29*a* opposed to the photosensitive drum 4, and the developing roller 6 is provided rotatably in the opening 29*a*. In the opening 29*a*, the developing blade 31 is fixed at a downstream position with respect to the rotational moving direction of the developing roller 6.

In an upstream side of the opening 29*a* with respect to the rotational moving direction of the developing roller 6, there is provided a fixing surface 34 for the toner sealing sheet 35, and the end of the toner sealing sheet 35 opposite the end portion contacting the developing roller 6 is fixed to the fixing surface 34. As shown in FIG. 3, the toner sealing sheet 35 is fixed to the toner sealing sheet fixing surface 34 so that a surface of the toner sealing sheet 35 contacts the developing roller 6.

The toner sealing sheet 35 is fixed to the toner sealing sheet fixing surface 34 at the side opposite the side contacted to the developing roller 6, using a double coated tape 39 in this embodiment, but the fixing method is may be another. The toner sealing sheet 35 is an elongated flexible sheet having two sides extending in the longitudinal direction, and is made of a polyethylene terephthalate sheet having a thickness of 50 μm, but the configuration and the material are not limited to this example. The toner sealing sheet 35 is curved and fixed on the toner sealing sheet fixing surface 34 in the state that a neighborhood of a longitudinally center portion of the toner sealing sheet 35 is convex toward the developing roller 6 in a direction perpendicular to the longitudinal direction.

A length of an image forming region in which the toner image is transferred onto the transfer belt 12 is m. The longitudinally extending side of the toner sealing sheet 35 contacting the developing roller 6 is warped by R2=0.1-1.5 mm adjacent the longitudinally center portion in the range of the image forming region m relative to the opposite end portions.

In part (a) of FIG. 1, a longitudinal range 34*a* of the toner sealing sheet fixing surface 34 has a length M2, ranges 34*b* and 34*c* are outside the range 34*a*. The toner sealing sheet fixing portions 34*b*, 34*c* extend in a direction away form the developing roller 6 in the direction perpendicular to the longitudinal direction (opposite direction).

In other words, the opposite end portions 34*b* and 34*c* (with respect to the rotational axial direction of the developing roller 6 developing roller 6) of the fixing surface 34 is wider than the neighborhood of the center portion (with respect to the rotational axial direction of the developing roller 6), in a direction perpendicular to the rotational axial direction of the developing roller 6, away from the opening 29*a* side.

In addition, the fixing surface 34 is wider outside the image forming region (with respect to the rotational axial direction of the developing roller 6) than in the image forming region, in a direction perpendicular to the rotational axial direction of the developing roller 6, away from the opening 29*a* side.

Referring to FIG. 8, further description will be made. In FIG. 8 (sectional view), the developing roller 6 is circular having a center point at which is the rotational axis point C3, and the toner sealing sheet contacts the developing roller at a contact point (C4). A tangent plane therebetween includes a tangent line L6 in the shown cross-section, and the end portion of the toner sealing sheet fixing surface 34 may extend toward an upstream side of the contact point with respect to the advancing direction (arrow Dl) of the surface of the developing roller 6.

The above-described structure may be employed in both of the residual toner collection sheet fixing surface 37 and the toner sealing sheet fixing surface 34, but it may be employed in the residual toner collection sheet fixing surface 37 only, or may be employed in the toner sealing sheet fixing surface 34 only.

By this, even if the toner sealing sheet 35 is curved by the curving degree R2, it can be fixed to the toner sealing sheet fixing surface 34 over the entire longitudinal area by the double coated tape 39, for example. In addition, the end portions 35*a*, 35*b* of the toner sealing sheet fixing surface 34 projected away from the developing roller 6 in the direction perpendicular to the longitudinal direction on the toner sealing sheet 35 are within the ranges of the toner sealing sheet fixing surfaces 34*b*, 34*c*, respectively.

At this time, the region M2 is widened toward a longitudinally outside beyond the image forming region m (outside the image forming region). A distance between the transfer belt 12 and the supporting portion 34*a* of the toner sealing sheet fixing surface is L3, and a distance between the transfer belt 12 and end portions 34*b*, 34*c* of the toner sealing sheet fixing surface is L4.

The distance L3 is larger than L4 so that the toner on the transfer belt 12 is not deposited onto the cleaner container 29 by an electrostatic force of the cleaner container 29. The distance L4 can be made close to such a distance that the end portions 34*b*, 34*c* of the toner sealing sheet fixing surface do not contact the surface of the transfer belt 12 even taking the dimensional variation due to the tolerance into consideration, and therefore, the cleaner container 29 and the image forming apparatus 1 can be downsized.

(Other Embodiments)

(1) in Embodiment 1, the process cartridge includes both of the cleaning unit 9 and the developing device 29. However, this is not inevitable. The process cartridge may include only one of the cleaning device 9 and the developing device 29.

(2) the cleaning device 9 or the developing device 29 may be a developing cartridge which is detachably mountable to the main assembly of the image forming apparatus, independently.

In Embodiment 1, the cleaning device, the developing device and the process cartridge are for the electrophotographic image forming apparatus using the electrophotographic photosensitive member as the image bearing member, but the image forming apparatus is not limited to the example. The present invention is applicable to a cleaning device, a developing device and a process cartridge for an electrostatic recording type image forming apparatus using a dielectric member for electrostatic recording as the image bearing member and to a process cartridge, a developing cartridge and a developing device for a magnetic recording type image forming apparatus using a magnetic member for magnetic recording as the image bearing member.

While the invention has been described with reference to the structures disclosed herein, it is not confined to the details set forth, and this application is intended to cover such modification or changes as may come within the purposes of the improvements or the scope of the following claims.

This application claims priority from Japanese Patent Applications Nos. 041364/2012 and 266166/2012 filed Feb. 28, 2012 and Dec. 5, 2012, respectively, which are hereby incorporated by reference.

What is claimed is:

1. A cleaning device mountable to an image forming apparatus including a rotatable image bearing member for bearing an image of a developer, said cleaning device comprising:

a cleaning member for removing the developer remaining on the image bearing member;

a cleaner container accommodating a developer removed by said cleaning member; and a sheet elastically contacting the image bearing member, wherein said cleaner container is provided with an opening, opposing the image bearing member, for permitting the developer removed from the image bearing member by said cleaning member to enter said cleaner container, wherein said cleaner container is provided with a fixing surface at an upstream side of the opening with respect to a rotational moving direction of the image bearing member, wherein said sheet is fixed to said fixing surface, wherein said fixing surface protrudes toward an upstream side with respect to the rotational moving direction, wherein said fixing surface includes an end portion and a center portion with respect to the rotational axis direction of the image bearing member, and wherein a length of the end portion from the opening to the upstream side is longer than that of the center portion.

2. A cleaning device according to claim 1, wherein at another end portion of said fixing surface with respect to the rotational axis direction of the image bearing member, said fixing surface protrudes toward the upstream side with respect to the rotational moving direction of the image bearing member beyond the central portion of said fixing surface.

3. A cleaning device according to claim 1, wherein a direction of protrusion of said fixing surface is away from said opening.

4. A cleaning device according to claim 1, wherein said sheet is convex toward the image bearing member.

5. A process cartridge comprising the rotatable image bearing member, and a cleaning device according to claim 1.

6. An image forming apparatus comprising the rotatable image bearing member, a cleaning device according to claim 1, and a discharging tray for receiving the recording material having a transferred developer image.

7. A cleaning device according to claim 1, wherein said sheet is flexible.

8. A cleaning device according to claim 1, wherein the image forming apparatus is configured to transfer the image of the developer onto a recording material.

9. A developing device mountable to an image forming apparatus, said developing device comprising:

a rotatable developer carrying member for carrying the developer and applying the developer to an image bearing member;

a developing container, having an opening opposing said developer carrying member, for accommodating the developer to be supplied to said developer carrying member; and a sheet elastically contacting said developer carrying member, wherein said developing container is provided with a fixing surface at an upstream side of the opening with respect to a rotational moving direction of the developer carrying member, wherein said sheet is fixed to said fixing surface, wherein said fixing surface protrudes toward an upstream side with respect to the rotational moving direction, wherein said fixing surface includes an end portion and a center portion with respect to a rotational axis direction of the developer carrying member, and wherein a length of the end portion from the opening to the upstream side is longer than that of the center portion.

10. A developing device according to claim 9, wherein at another end portion of said fixing surface with respect to the rotational axis direction of the developer carrying member, said fixing surface protrudes toward the upstream side with respect to the rotational moving direction of the developer carrying member beyond the central portion of said fixing surface.

11. A developing device according to claim 9, wherein a direction of protrusion of said fixing surface is away from said opening.

12. A developing device according to claim 9, wherein said sheet is convex toward said developer carrying member.

13. A process cartridge comprising the rotatable image bearing member, and said developing device according to claim 9.

14. An image forming apparatus comprising the rotatable image bearing member, a developing device according to claim 9, and a discharging tray for receiving the recording material having a transferred developer image.

15. A developing device according to claim 9, further comprising a layer thickness regulating member for regulating a layer thickness of the developer deposited on said developer carrying member, wherein said layer thickness regulating member is fixed at a position downstream of said opening with respect to a rotational moving direction of the developer carrying member.

16. A developing device according to claim 9, wherein said sheet is flexible.

17. A developing device according to claim 9, wherein the image bearing member is rotatable, and is configured to bear an image of a developer to be transferred onto a recording material.

* * * * *